US005186449A

United States Patent [19]

Ohmi et al.

[11] Patent Number: 5,186,449

[45] Date of Patent: Feb. 16, 1993

[54] SHEET FEEDER UNIT

[75] Inventors: Ikuhiro Ohmi, Osaka; Yoshiaki Yanagida, Hirakata; Soichi Matsuyama, Kyoto; Yoshihisa Ikuta, Toyonaka, all of Japan

[73] Assignee: Mita Industrial Co., Ltd., Osaka, Japan

[21] Appl. No.: 821,312

[22] Filed: Jan. 13, 1992

Related U.S. Application Data

[63] Continuation of Ser. No. 644,762, Jan. 23, 1991, abandoned.

[30] Foreign Application Priority Data

Jan. 23, 1990 [JP] Japan ..... 2-14549

[51] Int. Cl.[5] ..... B65H 5/00

[52] U.S. Cl. ..... 271/10; 271/111; 271/114; 271/265

[58] Field of Search ..... 271/10, 111, 114, 259

[56] References Cited

U.S. PATENT DOCUMENTS 4,318,540 3/1982 Paananen et al. ..... 271/265 X
4,331,328 5/1982 Fasig ..... 271/270

FOREIGN PATENT DOCUMENTS 0078052 5/1984 Japan ..... 271/265
0051429 3/1986 Japan ..... 271/270
0133843 5/1989 Japan ..... 271/265

*Primary Examiner*—H. Grant Skaggs
*Assistant Examiner*—Carol Lynn Druzbick
*Attorney, Agent, or Firm*—Armstrong, Westerman, Hattori, McLeland & Naughton

[57] ABSTRACT

The present invention is directed to the provision of a sheet feeder unit mounted in a copying machine or the like having a sheet transport mechanism. The sheet feeder unit feeds sheets to the sheet transport mechanism, and the sheets fed into the sheet transport mechanism are transported by the sheet transport mechanism. Each sheet being transported by the sheet transport mechanism is detected by a pair of sensors disposed with a prescribed space provided between each other, and the sheet transporting speed is calculated from the time in which the sheet travels the distance between the two sensors. The sheet feeding condition is set on the basis of the sheet transporting speed of the sheet feeder unit so that the sheets fed from the sheet feeder unit do not overlap each other.

1 Claim, 4 Drawing Sheets

SHEET FEEDER UNIT

This application is a continuation of application Ser. No. 644,762 filed Jan. 23, 1991, now abandoned.

BACKGROUND OF THE INVENTION

1. Field of the Invention

The present invention relates to a sheet feeder unit mounted in an image forming apparatus or the like having a sheet transport mechanism.

2. Description of the Prior Art

An image forming apparatus such as a copying machine is provided with a sheet transport mechanism for transporting copy paper. The sheet transport mechanism usually transports copy paper fed from a relatively compact paper cassette holding sheets of copy paper and mounted in the image forming apparatus.

A compact paper cassette usually mounted in a copying machine can only hold a limited number of sheets and therefore may run out of sheets when a large number of copies are to be made successively. In view of this problem, a large capacity sheet feeder unit capable of holding a large quantity of copy paper and having a mechanism to feed copy paper to the sheet transport mechanism is used instead of a conventional compact paper cassette. Use of such a sheet feeder unit permits continuous copying in large volumes.

Such a sheet feeder unit is detachably mounted in the copying machine, and the sheets contained therein are fed to the sheet transport mechanism by means of a paper feed roller driven by a driving means separately provided from that for the sheet transport mechanism of the copying machine. In recent years, in offices where large volumes of documents are handled, more than one copying machine has come to be installed, and it is sometimes the case that one sheet feeder unit is used with different copying machines. However, the sheet transporting speed of the sheet transport mechanism is not exactly the same between these different copying machines. Therefore, when making a large number of copies on one copying machine using such a sheet feeder unit, there is a possibility that a sheet fed from the sheet feeder unit into the sheet transport mechanism may overlap the preceding sheet being transported by the sheet transport mechanism, thereby causing jamming of paper. Particularly in the case of copying machines of different makers, the sheet transporting speed of the sheet transport mechanism may be greatly different between such machines, which, when one sheet feeder unit is shared between them, results in more chances of paper jamming.

SUMMARY OF THE INVENTION

The sheet feeder unit of this invention, which overcomes the above-discussed and numerous other disadvantages and deficiencies of the prior art, comprises a pair of sheet sensors disposed with a prescribed space provided between each other along the sheet transporting direction, each for detecting a sheet being fed into the sheet transport mechanism for transportation by the sheet transport mechanism; a calculating means for calculating the sheet transporting speed of the sheet transport mechanism on the basis of the detection results of the pair of sheet sensors; and a setting means for setting the sheet feeding condition on the basis of the calculation result so that a sheet is fed in a prescribed condition so as not to overlap the preceding sheet being transported by the sheet transport mechanism.

In a preferred embodiment, the sheet feeding condition set by the setting means is a time interval for feeding the sheets.

In a preferred embodiment, the sheet feeding condition set by the setting means is a speed at which the sheets are fed into the sheet transport mechanism.

Thus, in the sheet feeder unit of the present invention, the speed at which a sheet is transported by the sheet transport mechanism is calculated from the time in which the sheet being transported by the sheet transport mechanism travels the distance between the pair of sheet sensors disposed with a prescribed space provided between each other. Based on the thus calculated sheet transporting speed of the sheet transport mechanism, the sheet feeding time interval or the sheet transporting speed is controlled so that the sheet is fed into the sheet transport mechanism without overlapping the preceding sheet being transported by the sheet transport mechanism. Therefore, even when it is mounted in a copying machine having a different sheet transport mechanism, the sheet feeder unit can feed sheets successively into the sheet transport mechanism of the copying machine without causing paper jamming.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
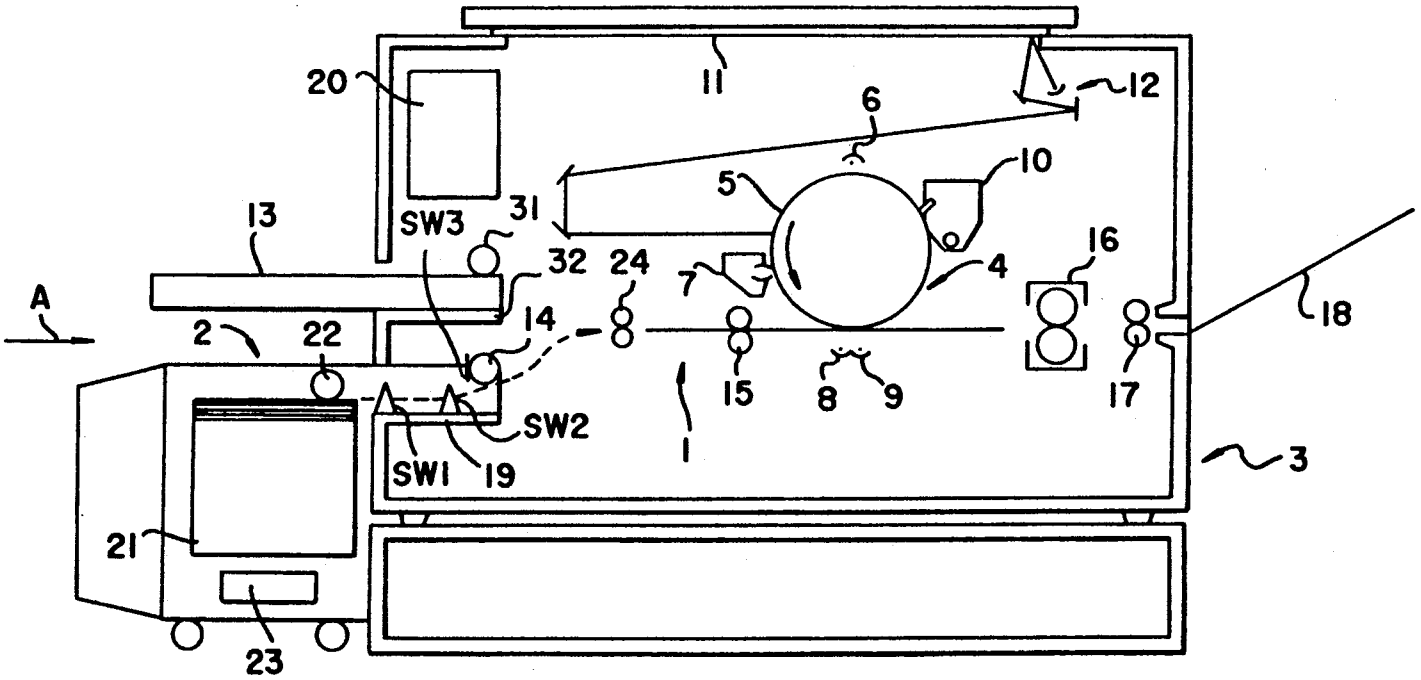
FIG. 1 is a schematic diagram illustrating the construction of a sheet feeder unit mounted in a copying machine according to the present invention.

As shown in FIG. 1, the sheet feeder unit of the present invention is mounted, for example, in a copying machine 3 which is an image forming apparatus.

The copying machine 3 has an image forming section 4. The image forming section 4 comprises a photoconductor drum 5 disposed in the middle part of the copying machine 3, a main charger unit 6, a developer unit 7, a transfer charger 8, a separation charger 9, and a cleaning unit 10, which are disposed around the photoconductor drum 5. An optical unit 12 for directing the image of a document placed on a contact glass 11 onto the photoconductor drum 5 is disposed above the image forming section 4, the optical unit 12 comprising a light source for exposing the document and a plurality of reflection mirrors.

The optical unit 12 and the image forming section 4 are used to form a toner image on the photoconductor drum 5 by a known image forming process and transfer the toner image onto a sheet of copy paper being transported beneath the image forming section 4.

Disposed beneath the image forming section 4 is a sheet transport mechanism 1 by which copy paper, fed from a sheet feeder unit 2 mounted in a sheet feeder unit mounting slot 19 of the copying machine 3 or from a paper cassette 13 mounted in a paper cassette mounting slot 32 provided above the sheet feeder unit mounting slot 19, is transported in such a way as to traverse through the copying machine 3. The transport mechanism 1 includes a paper feed roller 31 disposed in the paper cassette mounting slot 32 and a paper feed roller 14 disposed in the sheet feeder unit mounting slot 19, the paper feed rollers 31 and 14 being rotated when the copy switch is pressed on. The upper paper feed roller 31 rotates to feed into the sheet transport mechanism 1 the copy paper contained in the paper cassette 13, while on the other hand, the lower paper feed roller 14 rotates to feed into the sheet transport mechanism 1 the copy paper contained in the sheet feeder unit 2 mounted in the copying machine 3. The copy paper fed by either one of the paper feed rollers is transported by means of a transport roller 24 and a resist roller 15 toward a path beneath the photoconductor drum 5. When the copy paper passes beneath the photoconductor drum 5, a toner image formed on the photoconductor drum 5 is transferred onto the copy paper which is then transported on to a fixing unit 16. The toner image is fixed to the copy paper when it is passed through the fixing unit 16. The copy paper passed through the fixing unit 16 is discharged by means of a paper exit roller 17 onto a paper exit tray 18.

On the upstream side along the sheet transporting direction of the paper feed roller 14 that feeds copy paper contained in the sheet feeder unit 2 into the sheet transport mechanism 1, there is disposed a sheet sensor SW3 for detecting a sheet being fed.

The copying machine 3 is provided with a control section 20 which controls the operation of the copying machine in accordance with a prescribed procedure.

The sheet feeder unit 2 is moved in the direction of arrow A to fit into the sheet feeder unit mounting slot 19, and is moved in the opposite direction from the arrow A to detach it from the sheet feeder unit mounting slot 19.

The sheet feeder unit 2 has a sheet holding section 21 for holding sheets of copy paper and a paper feed roller 22 which rotates to feed a sheet of copy paper from the sheet holding section 21 in the direction shown by the broken line in FIG. 1. On the downstream side along the sheet transporting direction of the paper feed roller 22, there are disposed sheet sensors SW1 and SW2. There is also provided in the sheet feeder unit 2 a control section 23 for controlling the sheet feeding condition.

Figure 3:
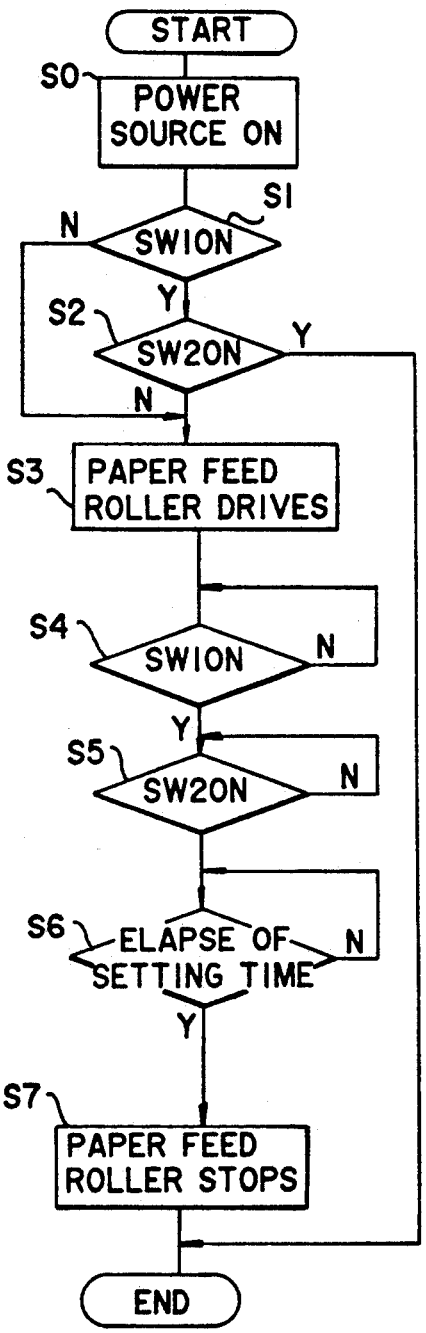
FIG. 3 is a flowchart explaining the sheet feeding operation of the sheet feeder unit.

According to the present invention, when the sheet feeder unit 2 is mounted in the copying machine 3, an initializing operation is performed so that the copy paper held in the sheet feeder unit 2 is placed in a prescribed initial condition. In the initializing operation, as shown in the flowchart of FIG. 3, when power is turned on to the sheet feeder unit 2 (Step S0), if the sheet sensor SW1 is in a deactivated state with no sheets detected (Step S1), it is judged that the copy paper in the sheet feeder unit 2 is not yet placed in the prescribed initial condition, and the paper feed roller 22 is driven for rotation (Step S3). With the rotation of the paper feed roller 22, the uppermost sheet in the paper holding section 21 is delivered toward the sheet transport mechanism 1 of the copying machine 3. As the sheet is transported, the sheet sensors SW1 and SW2 are activated (Steps S4 and S5), the paper feed roller 22 continuing to run to further transport the sheet. When a preset time has passed after the activation of the sheet sensor SW2 (Step S6), the rotation of the paper feed roller 22 stops (Step S7), thereby stopping the transportation of the sheet. The preset time herein means the time needed for the copy sheet to hit the paper feed roller 14 of the copying machine 3 and buckle slightly on the upstream side of the paper feed roller 14 after the leading edge thereof activated the sheet sensor SW2. In Steps S1 and S2, when the sheet sensors SW1 and SW2 are both in an activated state, it is judged that the sheet is already put in the prescribed initial condition, therefore, the initializing operation is not performed. Also, when the copy paper hits the paper feed roller 14, the sheet sensor SW3 disposed in the copying machine 3 is activated.

Figure 4:
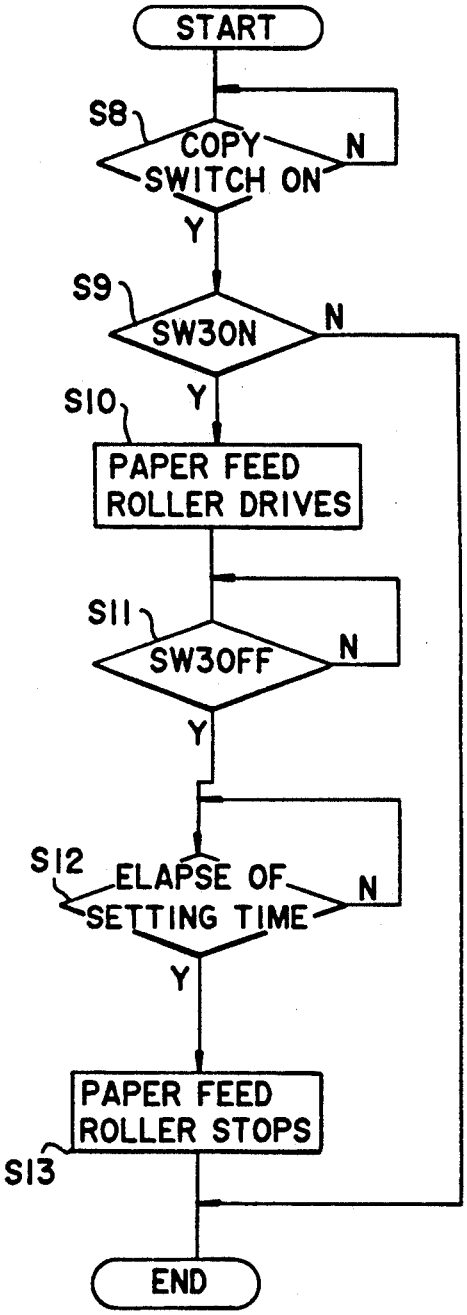
FIG. 4 is a flowchart explaining the operation of a sheet transport mechanism of the copying machine.

With the initializing operation thus completed in the sheet feeder unit 2, the copy switch on the copying machine 3 is pressed to feed the copy paper into the copying machine 3. FIG. 4 is a flowchart explaining how the transportation of the copy paper is controlled by the control section 20 of the copying machine 3. When the copy switch on the copying machine 3 is pressed (Step S8 in FIG. 4), the status of the sheet sensor SW3 disposed on the upstream side of the paper feed roller 14 of the copying machine 3 is checked. If the sheet sensor SW3 is not on, it means that the copy paper is not delivered to reach the paper feed roller 14 of the copying machine 3, therefore, the control section 20 of the copying machine 3 does not perform the transportation control of the sheet and notifies that the copy paper has not been transported by the sheet feeder unit 2. In Step S9, if the sheet sensor SW3 is on, it means that the copy paper is already put in the initial condition by the sheet feeder unit 2, therefore, the control section 20 performs operation to drive the paper feed roller 14 (Step S10), to transport the copy paper toward the photoconductor drum 5. When the sheet sensor SW3 is deactivated with the trailing edge of the copy paper passing the position of the sheet sensor SW3 (Step S11), a preset time starts counting (Step S12), at the end of which the rotation of the paper feed roller 14 stops.

The copy paper is now transported by the resist roller 15 in synchronization with the rotation of the photoconductor drum 5, and a toner image on the photoconductor drum 5 is transferred onto the copy paper. The copy paper with the toner image transferred thereon is transported onto the fixing unit 16 and is discharged onto the paper exit tray 18 by the paper exit roller 17.

According to the present invention, when the sheet feeder unit 2 is mounted in the copying machine 3, if a measuring mode is selected by operating a mode selector switch (not shown), the setting of the sheet feeding interval is changed as a result of the detection of the first copy paper by the sheet sensors SW1 and SW2.

Figure 5:
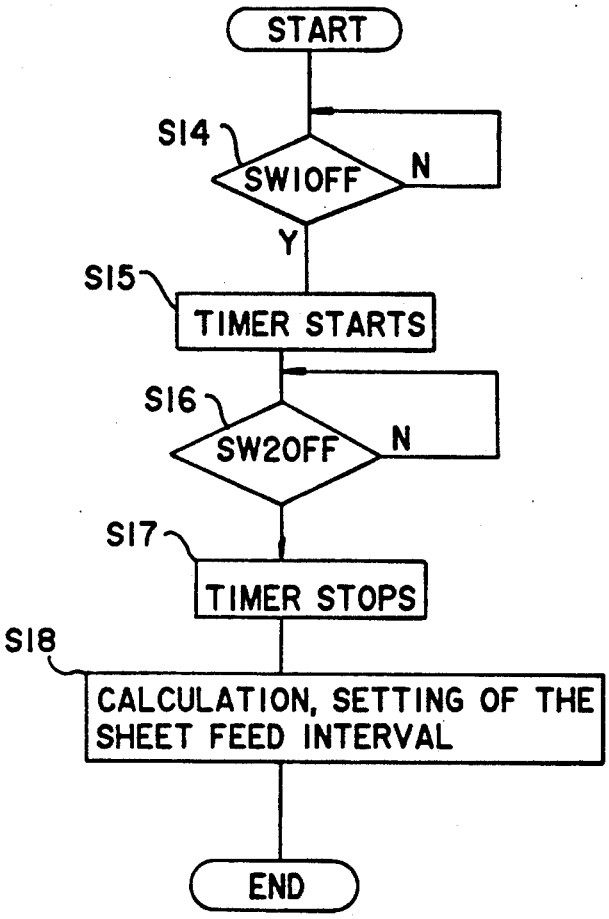
FIG. 5 is a flowchart explaining the operation for changing the time interval setting for feeding sheets by the sheet feeder unit.

When the copy switch on the copying machine 3 is pressed after the first copy paper has been placed in the initial condition by the sheet feeder unit 2, the copy paper that has been placed in the initial condition is fed into the copying machine 3. At this time, the copy paper is transported only by the rotation of the paper feed roller 14 of the copying machine 3. As shown in the flowchart of FIG. 5, the trailing edge of the copy paper passes the position of the sheet sensor SW1 in the sheet feeder unit 2 to deactivate the sheet sensor SW1 (Step S14 in FIG. 5) before the sheet sensor SW3 in the sheet transport mechanism 1 is deactivated with the trailing edge of the sheet passing the position of the sheet sensor SW3 (Step S11 in FIG. 4). With the deactivation of the sheet sensor SW1, the timer within the control section 23 starts counting (Step S15). After the deactivation of the sheet sensor SW1, when the trailing edge of the copy paper passes the position of the sheet sensor SW2 to deactivate the sheet sensor SW2 (Step S16), the timer stops (Step S17). Thus, the time t is measured so that the copy paper transported by the paper feed roller 14 of the sheet transport mechanism 1 takes to travel the distance between the sheet sensors SW1 and SW2 in the sheet feeder unit 2. Based on the time t and the known distance a between the sheet sensors SW1 and SW2 (see FIG. 2), the speed $V_1$ at which the copy paper is transported by the paper feed roller 14 of the sheet transport mechanism 1 is calculated by the following equation.

$$V_1 = \frac{a}{t}$$

Based on the calculated sheet transporting speed V1 of the sheet transport mechanism 1, a prescribed calculation is performed to change the setting of the interval at which the copy paper is fed from the sheet feeder unit 2 (Step S18).

Figure 2:
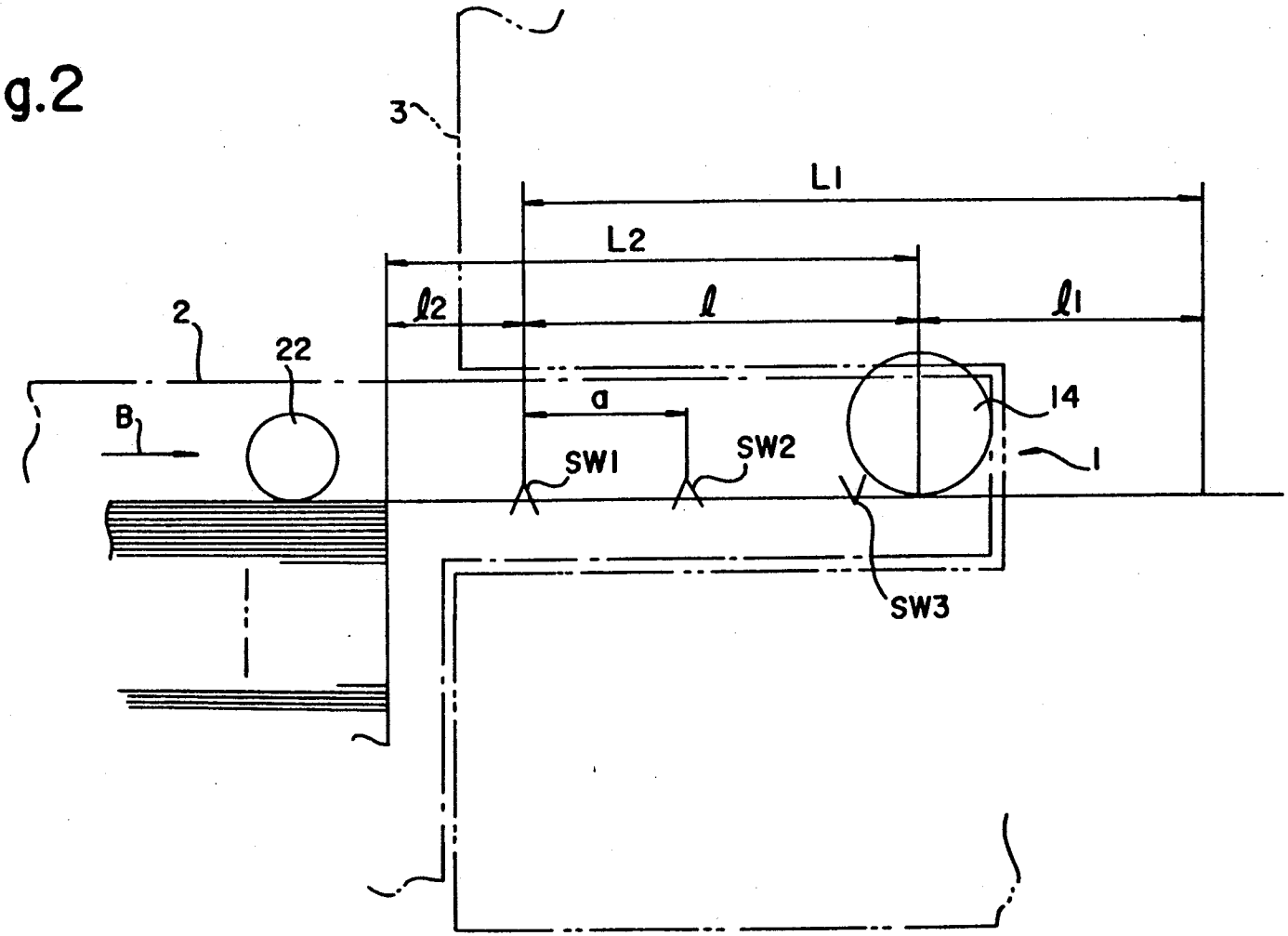
FIG. 2 is an enlarged view showing essential parts of FIG. 1.

The calculation performed in Step S18 is now explained with reference to FIG. 2. The sheet feeder unit 2 feeds the copy paper by means of the paper feed roller 22 in the direction of arrow B shown in FIG. 2. The copy paper passes the respective positions of the sheet sensors SW1, SW2 and the position of the sheet sensor SW3 in the sheet transport mechanism 1, before being fed by the paper feed roller 14 for transportation through the sheet transport mechanism 1. When sheets of copy paper are transported successively, control is performed so that a prescribed distance is provided between the trailing edge of a leading sheet being transported by the paper feed roller 14 of the sheet transport mechanism 1 and the leading edge of the next sheet, which is accomplished by controlling the time interval for feeding the next sheet by the paper feed roller 22 of the sheet feeder unit 2. The distance $l_1$ is provided to prevent the next sheet from overlapping the leading sheet even when there is a difference in the transporting speed between the paper feed roller 14 of the sheet transport mechanism 1 and the paper feed roller 22 of the sheet feeder unit 2.

Normally, in a copying operation, the sheet feeder unit 2 is controlled so that the paper feed roller 22 is driven to feed the next sheet when a sheet feeding time interval $\tau$ has elapsed after the deactivation of the sheet sensor SW1 with the passing of the trailing edge of the leading sheet. Therefore, the prescribed distance $l_1$ can be provided between the sheets by changing the sheet feeding time interval $\tau$.

When the distance between the leading sheet and the next sheet is denoted as $l_1$, a distance $L_1$, which the leading sheet travels from the time the trailing edge thereof being transported by the paper feed roller 14 reaches the sheet sensor SW1 (when the sheet sensor SW1 is deactivated) until the next sheet reaches the paper feed roller 14, is given as:

$$L_1 = l + l_1$$

(where l is the distance between SW1 and paper feed roller 14)

Since the leading sheet is transported by the paper feed roller 14 of the sheet transport mechanism 1 during the above period, a time $T_1$ needed to travel the distance $L_1$ can be calculated from the transporting speed $V_1$ of the transport mechanism obtained in Step S18 in FIG. 5, as follows:

$$T_1 = \frac{L_1}{V_1} = \frac{a(l + l_1)}{t}$$

(where a is the distance between the sheet sensors SW1 and SW2)

In the meantime, the leading edge of the next sheet, being fed by the paper feed roller 22 of the sheet feeder unit 2, reaches the paper feed roller 14 of the sheet transport mechanism 1. When the distance that the sheet travels for that period is denoted as $L_2$ and the time needed to travel the distance $L_2$ as $T_2$, the time $T_2$ with respect to the sheet transporting speed $V_2$ of the paper feed roller 22 can be expressed by the following equation.

$$T_2 = \frac{L_2}{V_2} = \frac{l + l_2}{V_2}$$

In practice, the time $T_2$ slightly varies because the sheet transporting speed is affected by the paper feed roller 14 when the leading edge of the next sheet hits the paper feed roller 14, but the variation is negligible and therefore is not considered.

From the above relationships, the sheet feeding time interval $\tau$ between the time the sheet sensor SW1 is deactivated by the trailing edge of the leading sheet and the time the paper feed roller 22 starts rotating is given by:

$$T_1 + \tau = T_2$$

which means, $$\tau = T_2 - T_1$$

Hence, $$\tau = \left(\frac{1}{V_2} - \frac{a}{t}\right) \cdot l - \frac{a}{t} \cdot l_1 + \frac{1}{V_2} \cdot l_2$$

The sheet transporting speed $V_2$ of the paper feed roller 22 of the sheet feeder unit 2 is already known, while the distance a between the sheet sensors SW1 and SW2, the distance l between the sheet sensor SW1 and the paper feed roller 14 of the sheet transport mechanism 1, and the distance $l_2$ between the sheet sensor SW1 and the leading edge of the sheet to be fed by the paper feed roller 22 of the sheet feeder unit 2 are already known as inherent values in the sheet feeder unit 2. Also, the time $\tau$ is measured as previously described. Therefore, by presetting only the distance $l_1$ between the sheets and storing it in the control section 23, the sheet feeding time interval $\tau$ of the sheet feeder unit 2 can be computed through calculation, the calculation result being set as a new sheet feeding time interval.

The sheet feeding time interval $\tau$ being thus set, the operation for continuous copying is performed in the following manner. When the copy switch on the copying machine 3 is pressed, the paper feed roller 14 starts rotating to transport the first copy sheet. When the sheet sensor SW1 is deactivated with the trailing edge of the copy sheet passing, over it, the paper feed roller 22 of the sheet feeder unit 2 starts rotating after the preset time $\tau$. This causes the next copy sheet to be transported to the sheet transport mechanism 1. At this time, since the first and next copy sheets are fed into the sheet transport mechanism 1 with a prescribed distance provided between each other, there is no possibility of the next sheet overlapping the first sheet, and thus, jamming of paper is prevented.

As described above, the time interval $\tau$ between the copy sheets delivered by the paper feed roller 22 of the sheet feeder unit 2 and transported by the paper feed roller 14 of the sheet transport mechanism 1 is set using only the detection results of the sheet sensors SW1 and SW2 provided in the sheet feeder unit 2. This, therefore, enables the sheet feeder unit 2 mounted in the copy machine 3 to feed copy sheets at appropriate intervals regardless of the sheet transporting speed of the sheet transport mechanism 1 of the copying machine 3.

In the above example, the interval for feeding paper from the sheet feeder unit is changed on the basis of the sheet transporting speed of the sheet transport mechanism, but alternatively, it may be so constructed that the rotating speed of the paper feed roller of the sheet feeder unit is changed on the basis of the sheet transporting speed of the sheet transport mechanism, thereby changing the sheet transporting speed of the paper feed roller. In this case, the transporting speed of the sheet transport mechanism is obtained beforehand as described in the above example, and the data in the control section 23 of the sheet feeder unit is rewritten so as to provide the same speed as the transporting speed of the sheet transport mechanism.

Also, the interval for feeding paper from the sheet feeder unit may be changed together with the feeding speed thereof.

In the above example, a sheet feeder unit mounted in a copying machine having a sheet transport mechanism has been described, but the invention is not limited to the described application but can also be applied to a sheet feeder unit to be mounted on a printer or the like having a sheet transport mechanism.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A sheet feeder unit which is detachably mounted on an apparatus having a sheet transport mechanism for transporting sheets at a prescribed speed, comprising:

a sheet feeder roller which feeds sheets into the sheet transport mechanism;

a pair of sheet sensors disposed with a prescribed space provided between each other along a sheet transporting direction, each for detecting a sheet being fed into the sheet transport mechanism for transportation by the sheet transport mechansim;

a calculating means for calculating the sheet transporting speed of the sheet transport mechanism on the basis of the detection results of the pair of sheet sensors;

a setting means for setting the time required for one of the sensors to detect a trailing edge of the sheet; and a control means for controlling the sheet feeder roller to supply the next sheet, from the sheet feeder unit to the sheet transport mechanism, on the basis of the calculation result and for intermittently feeding a sheet in a prescribed condition without overlapping the preceding sheet being transported by the sheet transport mechanism.

* * * * *